United States Patent [19]

Trigon

[11] 4,101,902

[45] Jul. 18, 1978

[54] ELECTRONIC SCANNING ANTENNA

[75] Inventor: Roland Trigon, Paris, France

[73] Assignee: Thomson-CSF, Paris, France

[21] Appl. No.: 740,834

[22] Filed: Nov. 10, 1976

[51] Int. Cl.[2] ..... H01Q 3/26; H01Q 3/00; H01Q 13/00; H01Q 21/10

[52] U.S. Cl. ..... 343/854; 343/757; 343/778; 343/827

[58] Field of Search ..... 343/757, 776, 778, 810, 343/824, 826, 827, 854, 893

[56] References Cited

U.S. PATENT DOCUMENTS

| | | | |
|---|---|---|---|
| 3,323,127 | 5/1967 | Vogel | 343/824 |
| 3,990,077 | 11/1976 | Beaulieu et al. | 343/854 |

OTHER PUBLICATIONS

Blass, J., *Multidirectional Antenna, A New Approach to Stacked Beams,* IRE National Convention, 1960.

*New Look in Radar,* Electronics World, Feb., 1965.

*Primary Examiner*—Alfred E. Smith

*Assistant Examiner*—Harry Barlow

*Attorney, Agent, or Firm*—Karl F. Ross

[57] ABSTRACT

There is described an electronic scanning antenna comprising a multiplicity of elementary radiators arranged for example in a vertical plane and constituting an array designed for simultaneous surveillance and tracking, the array being fed by two parallel waveguides. The first waveguide is connected to the radiators through a set of first couplers in cascade with a set of fixed phase shifters. The second waveguide is connected to the radiators through a set of second couplers in cascade with a set of variable phase shifters and with the first couplers and the fixed phase shifters. The waveguides are connected to respective transmitters and receivers operating at different frequencies. The complete assembly produces simultaneously at least one tracking beam which varies in elevation and one searching beam having a fixed, preferably low elevation angle.

6 Claims, 10 Drawing Figures

VARIABLE PHASE

ELECTRONIC SCANNING ANTENNA

FIELD OF THE INVENTION

The present invention relates to an electronically scannable antenna serving to produce a plurality of directional beams which point in directions defined by different angles of elevation, these beams being capable of passing from one angle of elevation to another under the control of phase shifters associated with elementary sources or radiators transmitting outgoing electromagnetic energy or receiving part of that energy returned by a target.

BACKGROUND OF THE INVENTION

Antennas of this type, given a movement of rotation in azimuth, permit the determination of the altitude of the located objects and also the tracking of these objects. However, if it is desired to maintain a surveillance or search during tracking, it is necessary to provide a separate antenna associated with another detecting system.

In commonly owned U.S. Pat. No. 3,448,450 there has been proposed a system wherein a number of radiators or elementary sources are spaced apart vertically and excited simultaneously through respective phase shifters which produce a number of beams stacked in elevation, the angle of elevation of these beams being made variable by concurrent adjustments of the phase shifters. This system is particularly adapted for the evaluation of the altitude of tracked targets and is associated with an additional radar provided with a special antenna rotating in azimuth and effecting a surveillance.

An antenna of such system comprises a number of radiating sources spaced apart vertically and coupled through phase shifters with two feed waveguides parallel to each other. One of these waveguides is connected through a rotary coupling and a multiplexer to three transmitters operating at three different frequencies, the other of these waveguides being connected directly to the receiver of the assembly the couplers connecting that waveguide to the radiating sources impart to the incoming fields a distribution of the difference type. The assembly consequently constitutes a transmitter-receiver operating as a monopulse radar.

In order to effect a surveillance in this instance during the evaluation of the altitude of the objects or their tracking, another radar must be provided.

Thus, such an arrangement requires two different systems with distinct modes of operation, the surveillance system being a panoramic radar in which the rotation of the antenna has to be synchronized with that of the waveguides of the electronically scanned antenna.

OBJECT OF THE INVENTION

The object of the present invention is to avoid the need for an extra radar designed for surveillance and to give this function to the radar provided with the electronically scanned antenna.

SUMMARY OF THE INVENTION

I realize this object, in accordance with my present invention, by providing a first and a second waveguide paralleling a linear array of vertically stacked radiators capable of emitting and intercepting microwave energy, the two waveguides communicating with respective sets of first and second couplers at a number of spaced-apart locations corresponding to the number of radiators. A set of fixed phase shifters, respectively inserted between the first couplers and the radiators, energize the latter to emit a first beam (referred to hereinafter as a search beam) of microwave energy at an operating frequency of a first transmitter connected to the first waveguide. A set of variable phase shifters, respectively inserted between the first and second couplers in cascade with the fixed phase shifters, energize the radiators to emit a second beam (referred to hereinafter as a tracking beam) of microwave energy at an operating frequency of a second transmitter connected to the second waveguide. Whereas the search beam has a predetermined angle of elevation, the angle of the tracking beam can be selectively changed since it depends on the setting of the variable phase shifters. Intercepted echoes at the frequencies of the search beam and the tracking beam are respectively detected by a first and a second receiver connected to the first and the second waveguide.

According to another feature of my invention, a third waveguide paralleling the array of radiators may communicate with a set of third couplers connected by way of a set of invariable phase shifters to the couplers of the second waveguide so as to be in cascade with the variable phase shifters. A third receiver connected to this third waveguide detects intercepted echoes at the operating frequency of the second transmitter in a mode different from that of the second receiver, i.e., in a difference mode if the second receiver works in a summing mode.

Pursuant to a further feature of my invention, each waveguide may be provided with a plurality of transmitters of different operating frequencies connected via a multiplexer to an input of a duplexer whose output is connected via another multiplexer to a plurality of receivers. With close enough spacing of the operating frequencies of the transmitters associated with each waveguide, a plurality of fixed-elevation beams and a plurality of jointly displaceable variable-elevation beams can be generated.

BRIEF DESCRIPTION OF THE DRAWING

I shall now describe my invention in greater detail with reference to the accompanying drawing in which.

SPECIFIC DESCRIPTION

Figure 1:
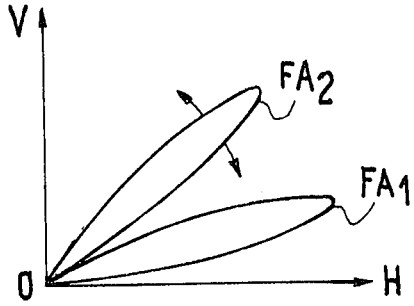
FIG. 1 is a diagram showing the fixed and movable beams obtained with an antenna according to the invention.

A radar system according to my invention comprises a single antenna array producing, as shown in FIG. 1, at least one fixed-elevation beam $FA_1$ preferably oriented at a low angle of elevation, serving for surveillance, and at least one variable elevation beam $FA_2$ allowing the tracking and/or the determination of the altitude of the targets which have been detected by the search beam $FA_1$ which is movable in azimuth.

Figure 2:
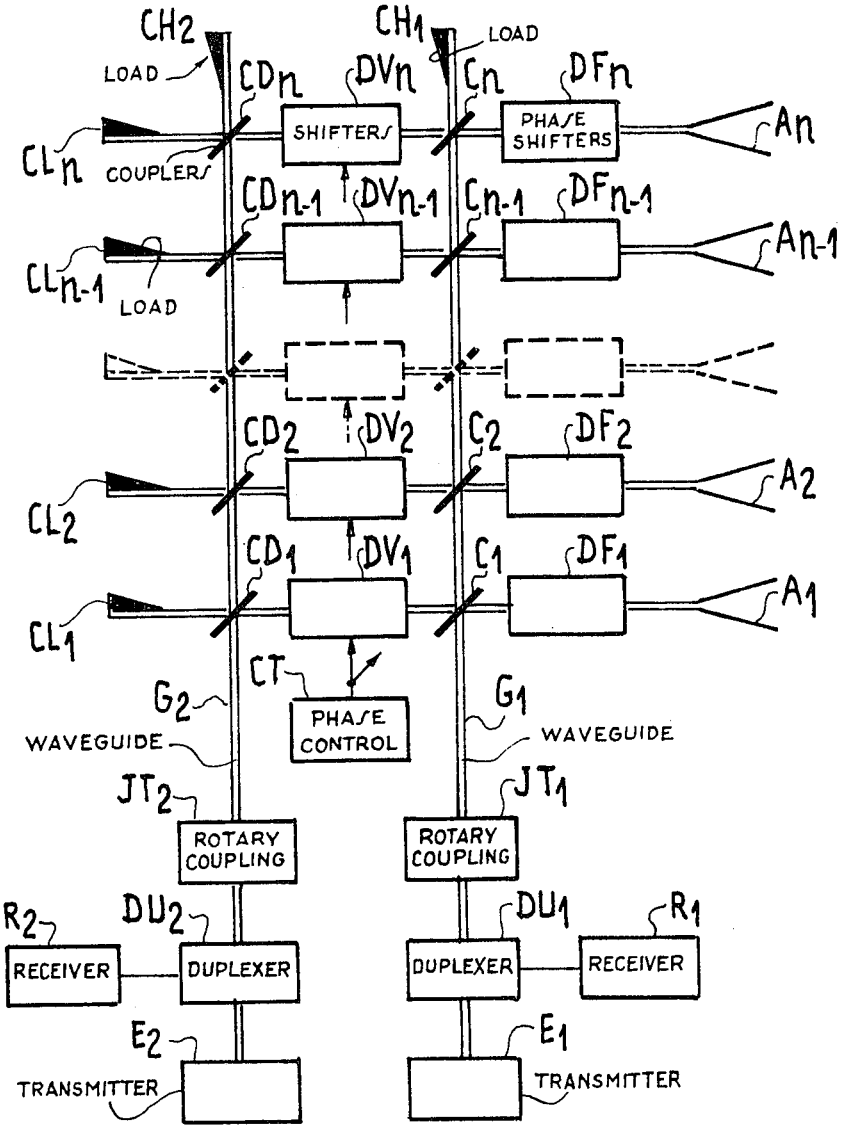
FIG. 2 is a block diagram of an embodiment of my invention comprising an antenna with two feed waveguides.

FIG. 2 shows a block diagram of an antenna array according to the invention.

A multiplicity of elementary radiators $A_1$ to $A_n$ for example in the form of horns, are disposed one above the other and capable of transmitting energy into space and receiving echoes from reflecting objects. These radiators are part of an assembly which rotates in azimuth about a vertical axis in the illustrated embodiment. The radiating elements may be associated with a reflector which, however, has not been shown in the Figure. These radiating elements $A_1$ to $A_n$ are connected through phase shifters $DF_1$ to $DF_n$, having a fixed phase-shift value, with a waveguide $G_1$ connected on the one hand, through a rotary coupling $JT_1$ and a duplexer $DU_1$, to a transmitter $E_1$ operating at a frequency $f1$ and, on the other hand, to a load $CH_1$. The connection of the several radiating elements to the waveguide is achieved by directional couplers $C_1$ to $C_n$, respectively.

A second waveguide $G_2$, disposed downstream of the first waveguide $G_1$, is connected to the several radiators $A_1$–$A_n$ and the waveguide $G_1$ through transmission lines carrying phase shifters $DV_1$ to $DV_n$ which are variable and controlled by an element such as a computer CT. The connection to the guide $G_2$ is achieved by directional couplers $CD_1$ to $CD_n$ one branch of which is connected with a load $CL_1$ to $CD_n$. The waveguide $G_2$ is connected at one of its ends, through a rotary coupling $JT_2$ and a duplexer $DU_2$, with a transmitter $E_2$ operating at a frequence $f2$ and at its other end with a load $CH_2$. Duplexers $DU_1$ and $DU_2$ are also connected to respective receivers $R_1$ and $R_2$.

The system shown in FIG. 2 operates in the following manner. The electromagnetic energy produced by the transmitter $E_1$ feeds the several radiating sources $A_1$ – $A_n$ in series through the corresponding directional couplers $C_1$ – $C_n$. The feed waveguide $G_1$ is dispersive and the seat of a progressive wave, and the direction of the maximum radiation of the resulting beam $FA_1$ depends on the frequency of the transmitter $E_1$. At this frequency $f1$, and with invariable phase shifts introduced by components $DF_1$ to $DF_n$ inserted in the connections between the waveguide $G_1$ and the radiating elements $A_1$– $A_n$, it is possible to obtain a search beam $FA_1$ aimed in a well-determined given direction. According to the invention, this direction with a preferably low angle of elevation which is fixed in a surveillance mode.

The waveguide $G_2$, located downstream of the waveguide $G_1$, which is parallel, thereto is fed by the transmitter $E_2$ operating at frequency $f2$. With the aid of directional couplers $CD_1$ to $CD_n$, whose main outputs are connected to respective branches of the corresponding coupling elements $C_1$ to $C_n$ through transmission lines including respective phase shifters $DV_1$ – $DV_n$, the elements $A_1$ to $A_n$ radiate a second beam $FA_2$ independent of the first beam $FA_1$. In fact, the feeds of the waveguides $G_1$ and $G_2$ are independent and their inputs are decoupled. As the phase shifters $DV_1$ to $DV_n$ respectively inserted in the transmission lines linking the waveguide $G_2$ with the couplers $C_1$ to $C_n$ are variable and controlled electronically by the circuit CT, the beam $FA_2$ has an adjustable angle of elevation and is capable of assuming, depending on the values set in the variable phase shifters $DV_1$ – $DV_n$, any one of a number of directions within a wide angular range substantially of the order of 50°.

It will be observed that the setting of the variable phase shifters effected at the frequency $f1$ will permit the beam $FA_2$, produced by the waveguide $G_2$, to point at a given instant in the same direction as the beam $FA_1$. This arrangement is utilized for producing in this direction, by the waveguide $G_2$, a difference pattern which permits the search beam $FA_1$ to have a reception on the sum pattern established by the waveguide $G_1$ and on the difference pattern established by the waveguide $G_2$. In this case, however, the waveguide $G_2$ is connected to a receiver set at the frequency $f1$.

Figure 3:
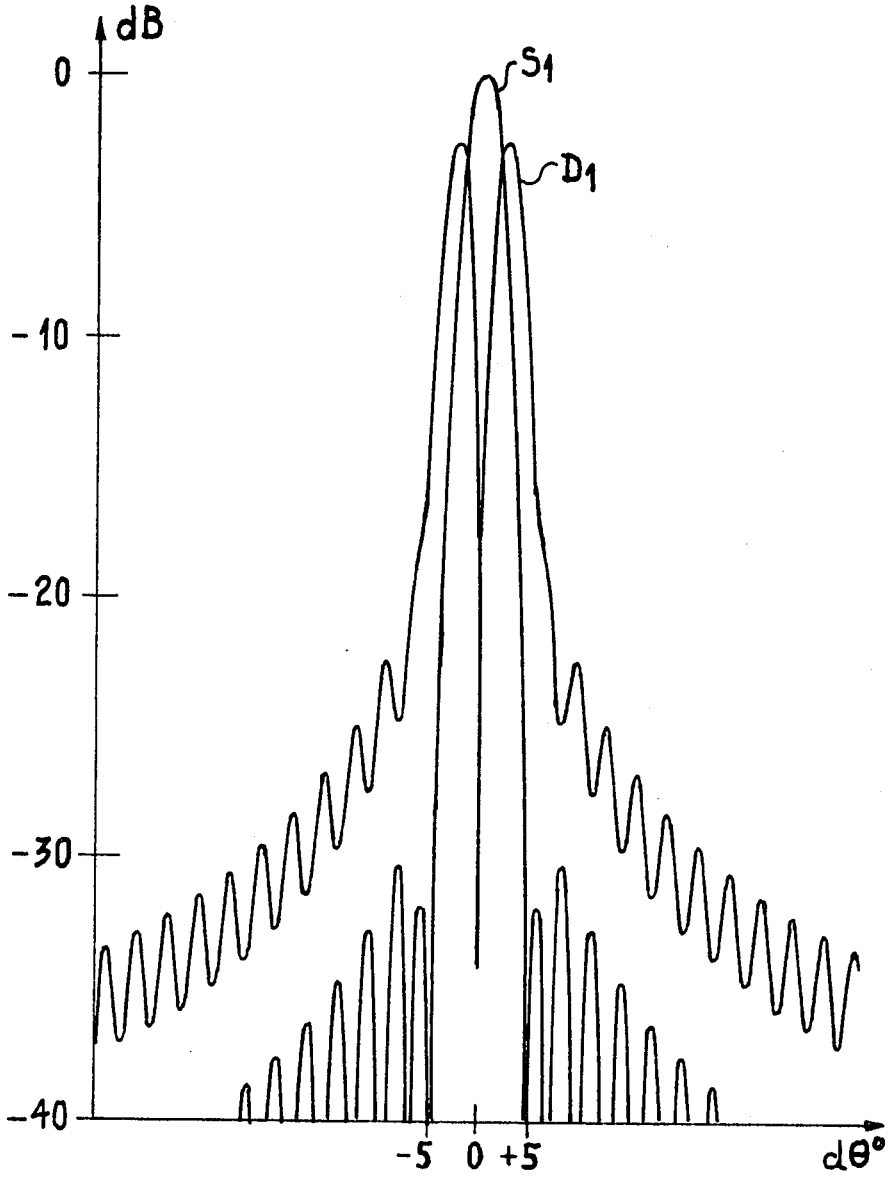
FIG. 3 shows the radiation patterns of the radiators fed at one and the same frequency by the feed waveguides of FIG. 2.

In FIG. 3 I have plotted in decibels, for positive and negative angles $d\theta$, these sum and difference patterns $S_1$ and $D_1$ respectively obtained from the waveguide $G_1$ for the sum and the waveguide $G_2$ for the difference, both waveguides operating at frequency $f1$.

Figure 4:
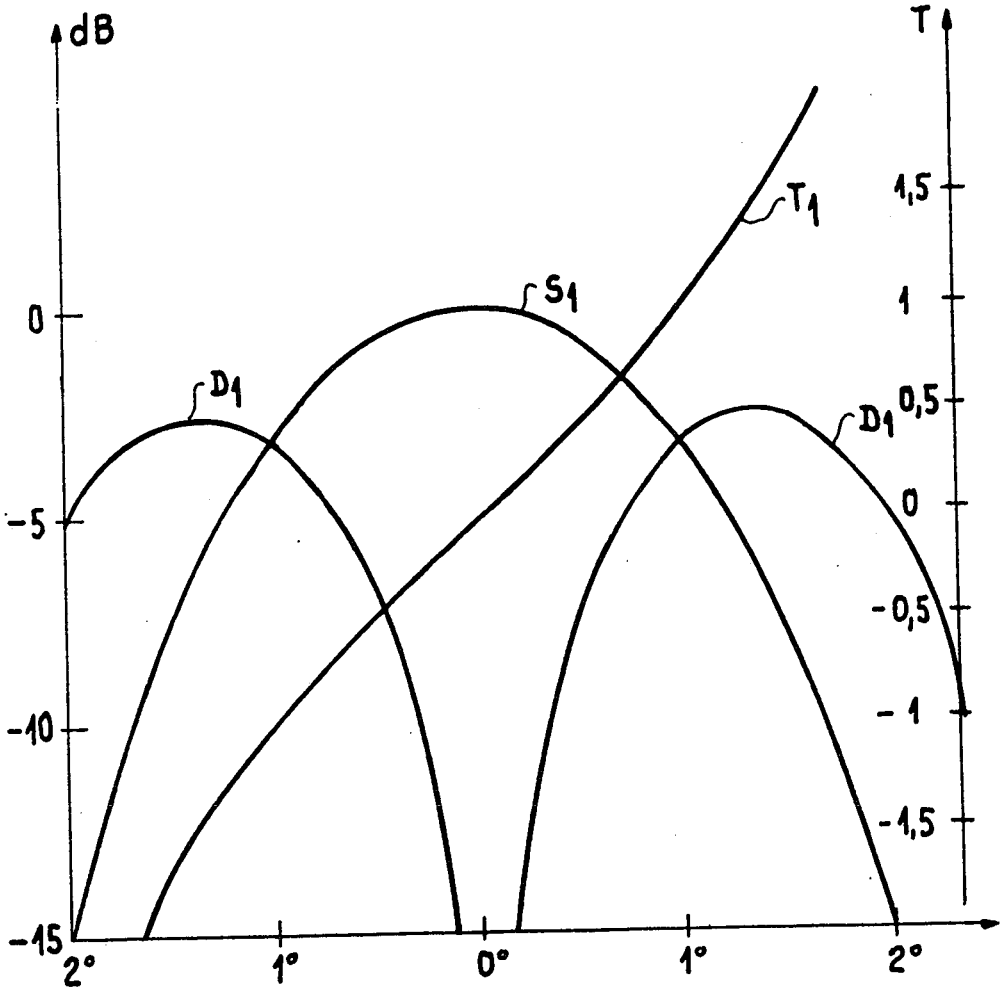
FIG. 4 is a graph similar to part of FIG. 3 but drawn to a larger scale and showing an angular-deviation curve.

FIG. 4 reproduces part of the curves $S_1$ and $D_1$ of FIG. 3 for a narrower angular range centered on the axis of beam $FA_1$ perpendicular to the array. Also shown is an angle-deviation curve $T_1$, plotted on a scale T, which has a large linear part in the vicinity of the axis.

Apart from this particular value for the direction assigned to the beam $FA_1$, the tracking beam $FA_2$ produced by the waveguide $G_2$ has a pattern of the sum type utilized of course for both transmission and reception.

Figure 5:
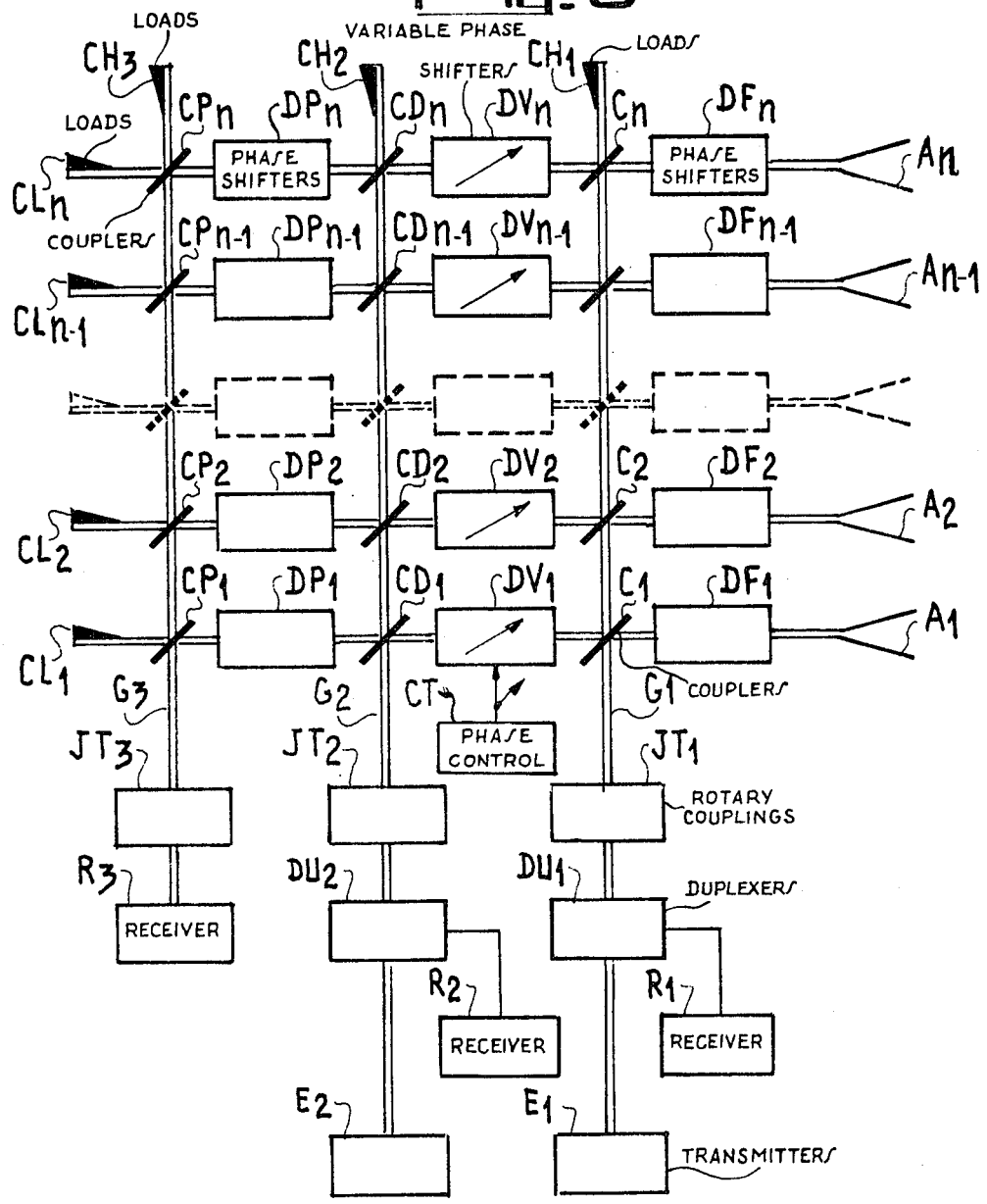
FIG. 5 is a block diagram of another embodiment provided with an antenna having three feed waveguides.

FIG. 5 shows a modification of the antenna illustrated in FIG. 2 in which there has been added a third waveguide $G_3$ which is parallel to the first two waveguides $G_1$ and $G_2$. This waveguide $G_3$ is connected at one of its ends, via a rotary coupling $JT_3$, to a receiver $R_3$ set at the frequency $f2$ and at its other end to a load $CH_3$. It is connected to the radiating sources $A_1$ – $A_n$ through couplers $CP_1$ to $CP_n$. The connection between the couplers and the radiating sources includes a set of fixed phase shifters $DP_1$ to $DP_n$. This connection is continued through the couplers $CD_1$ to $C_n$, the variable phase shifters $DV_1$ to $DV_n$, the couplers $C_1$ to $C_n$ and the fixed phase shifters $DF_1$ to $DF_n$.

When the radiating sources $A_1$ to $A_n$ operate at frequency $f2$, they generate an overall radiation pattern of the difference type corresponding to that of the sum type produced by the transmitter $E_2$ and the feed waveguide $G_2$.

This modification consequently provides an antenna using electronic scanning which is movable in azimuth and produces in a common vertical plane a search beam and a tracking beam with a variable angle of elevation, the antenna being so arranged that, for each beam radiated in a summing mode, the reception is in the same mode at $R_2$ and in a difference mode at $R_3$.

The remaining elements of FIG. 5 correspond to those of FIG. 2.

It will be apparent that, in the modification of FIG. 5, the reception with a difference pattern produced by the waveguide $G_2$ at the angle of elevation of the fixed beam may be canceled.

Figure 6:
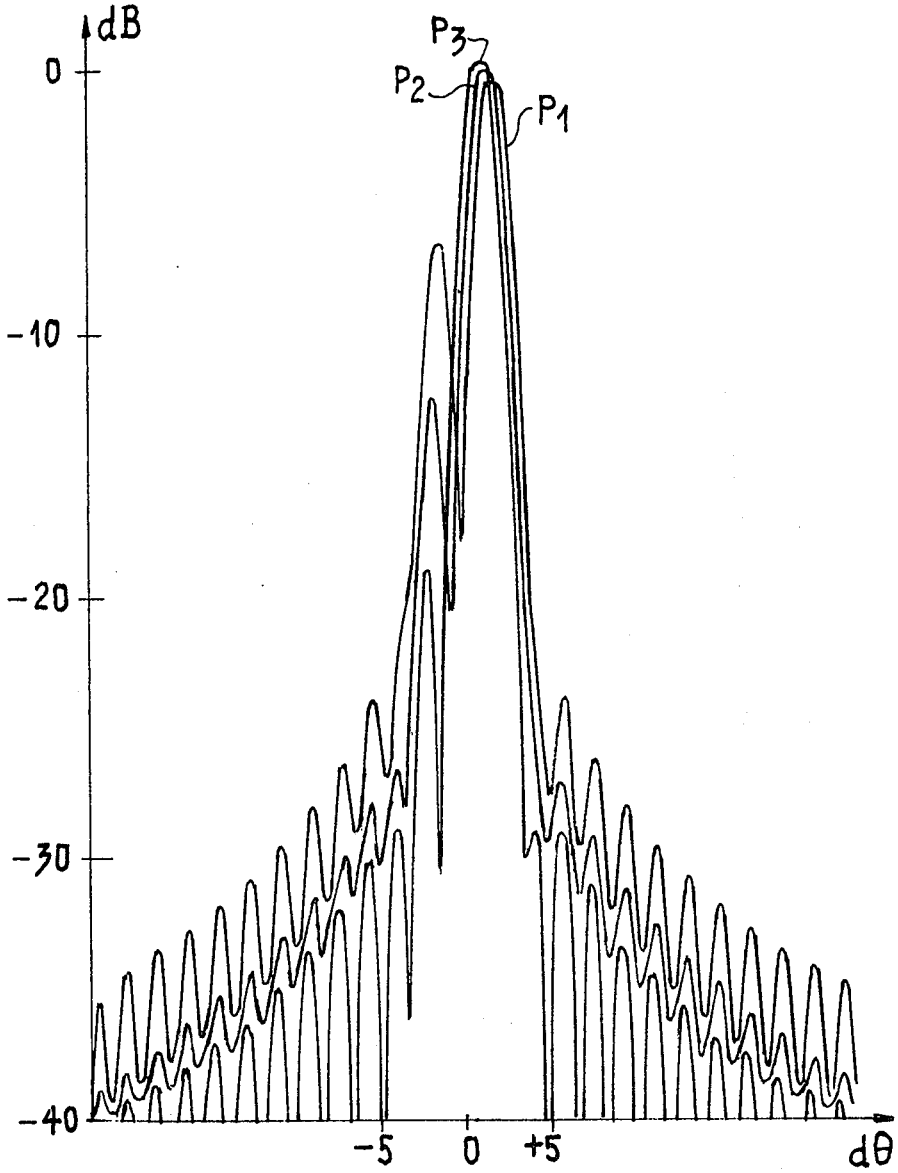
FIGS. 6, 7 and 8 are radiation patterns of the radiators for different orders for the aiming of the movable beam.
Figure 7:
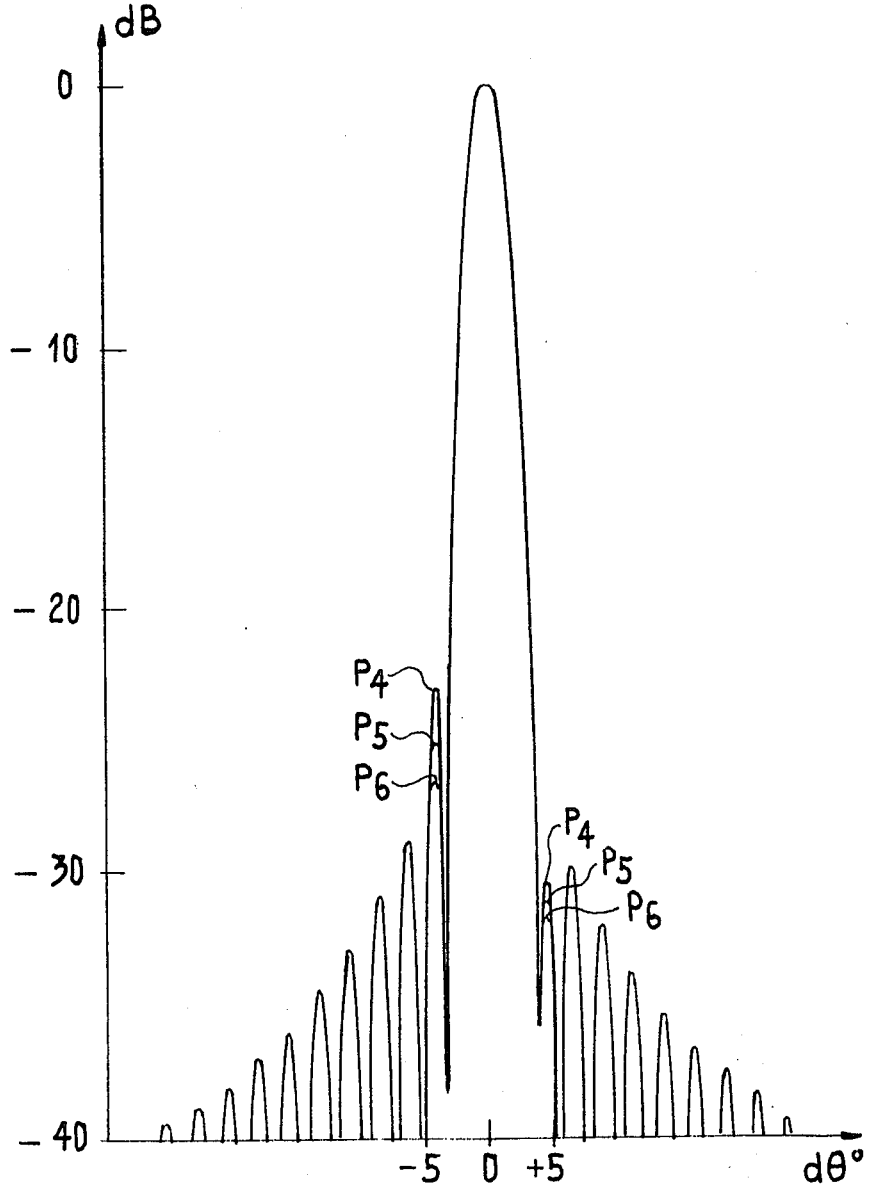
Figure 8:
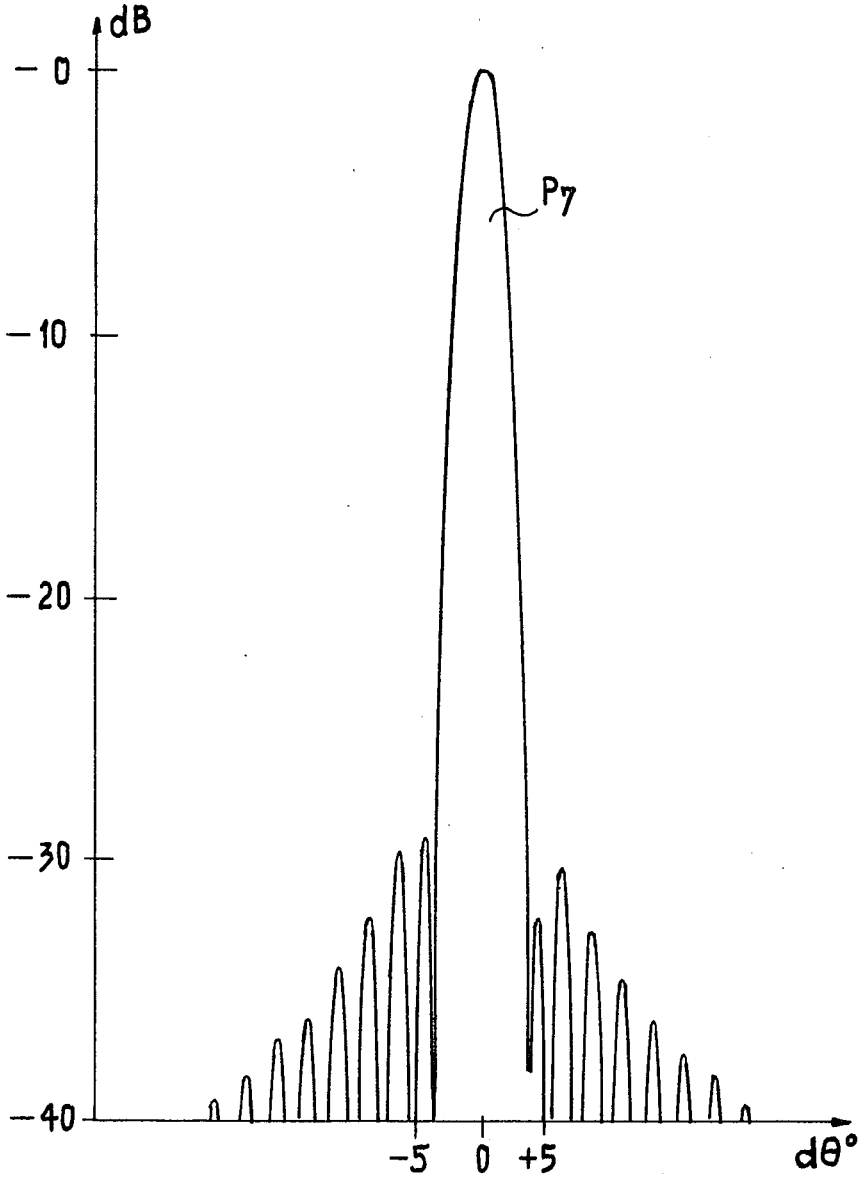

FIGS. 6 to 9 show patterns obtained by the feeding of the antenna by the waveguide $G_2$ as a function of aiming orders with omission, for convenience, of the linear phase function corresponding to the aiming order. The diagrams of FIGS. 6 – 8 are drawn to similar scales allowing their superposition within the limits of a certain aiming error.

It will be observed from these figures that in the concrete case they represent, in which about 40 radiators spaced apart 83 mm in the band S are employed, this corresponds to a beam of 2° in width at half power; a beam aimed at 3° has a first lobe at 19 dB and a beam aimed at 4° has a first lobe at 23 dB.

In FIG. 6 there are shown patterns $P_1$, $P_2$ and $P_3$ obtained from the waveguide $G_2$ as a function of the aiming orders at 1°, 2° and 3°, respectively.

FIG. 7 shows patterns $P_4$, $P_5$ and $P_6$ for beam-aiming orders corresponding to 4°, 5° and 6° respectively. FIG. 8 shows the pattern $P_7$ for a beam-aiming order corresponding to 10°.

Other patterns of the same type could also be represented which would show, like those illustrated in the Figures, that the sum patterns of the radiating sources fed by the waveguide $G_2$ are of a quality which improves progressively as one moves away from the first beam.

Figure 9:
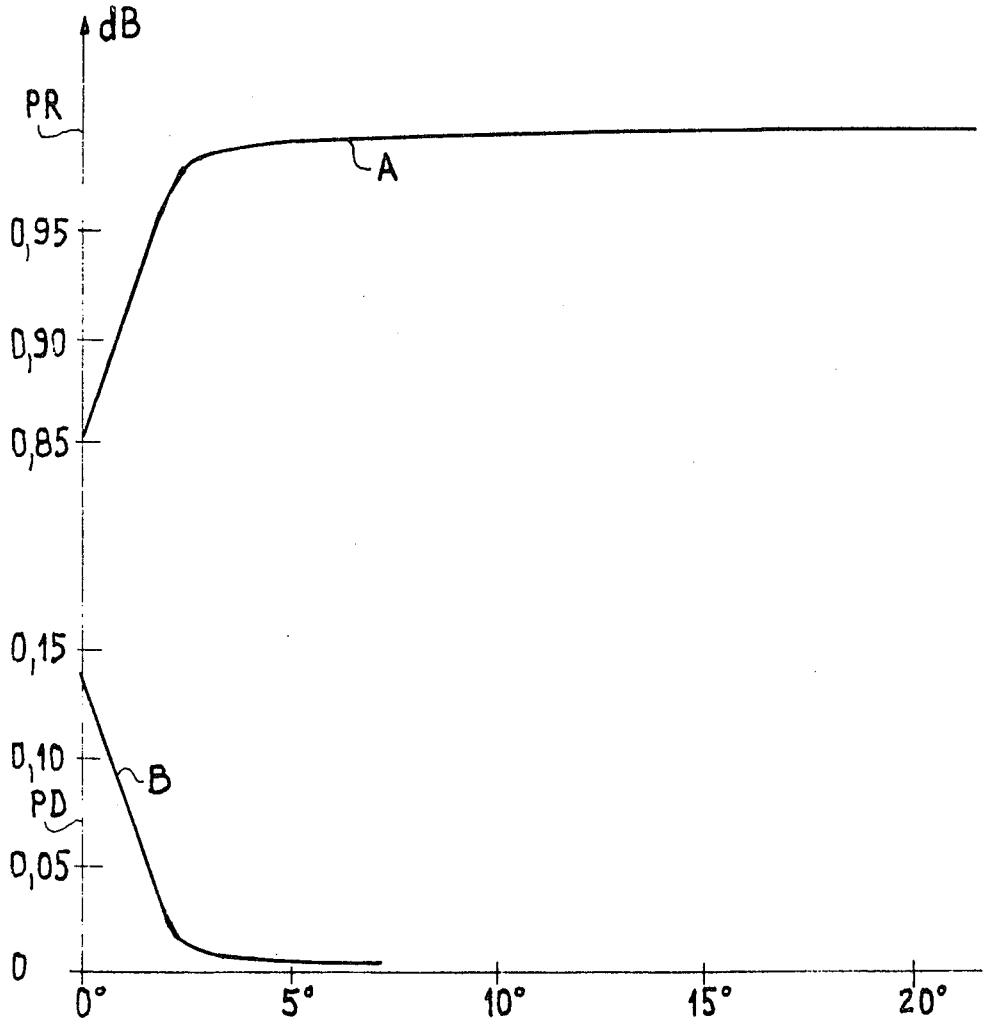
FIG. 9 shows the curves of the distribution of the power exciting the second waveguide of FIG. 2 as a function of error.

FIG. 9 shows the distribution of the power between the radiators and the loads $CH_1$ and $CH_2$ at the end of the two waveguides $G_1$ and $G_2$ respectively, upon excitation of the waveguide $G_2$ according to the various aimining orders. From the aiming order of 3° on, the power dissipated in the load $CH_1$ of the waveguide $G_1$ is acceptable and of the order of 1 percent. In any case, with suitable design, the load $CH_2$ of the waveguide $G_2$ dissipates the same power as the load $CH_1$ of the waveguide $G_1$ when it is excited, that is to say 1 to 2% of the total power. The curve A gives the radiated power PR as a function of the aiming error of the beam $FA_2$; the curve B gives the power PD dissipated in the load $CH_1$ of the waveguide $G_1$.

The couplers linking the feed waveguides with the radiating sources are of conventional construction. They are generally constituted by waveguide junctions whose branches have coupling factors or transfer coefficients determined in such manner that the energy is correctly distributed throughout the length of the array.

Although the foregoing description has been limited to the production of one fixed-elevation beam and one variable-elevation beam, I may extend the system by multiplying the number of transmitters and receivers to obtain with the described antenna a multibeam coverage with, for example, two search beams having low angles of elevation and one or more tracking beams whose angles of elevation may be jointly varied.

Figure 10:
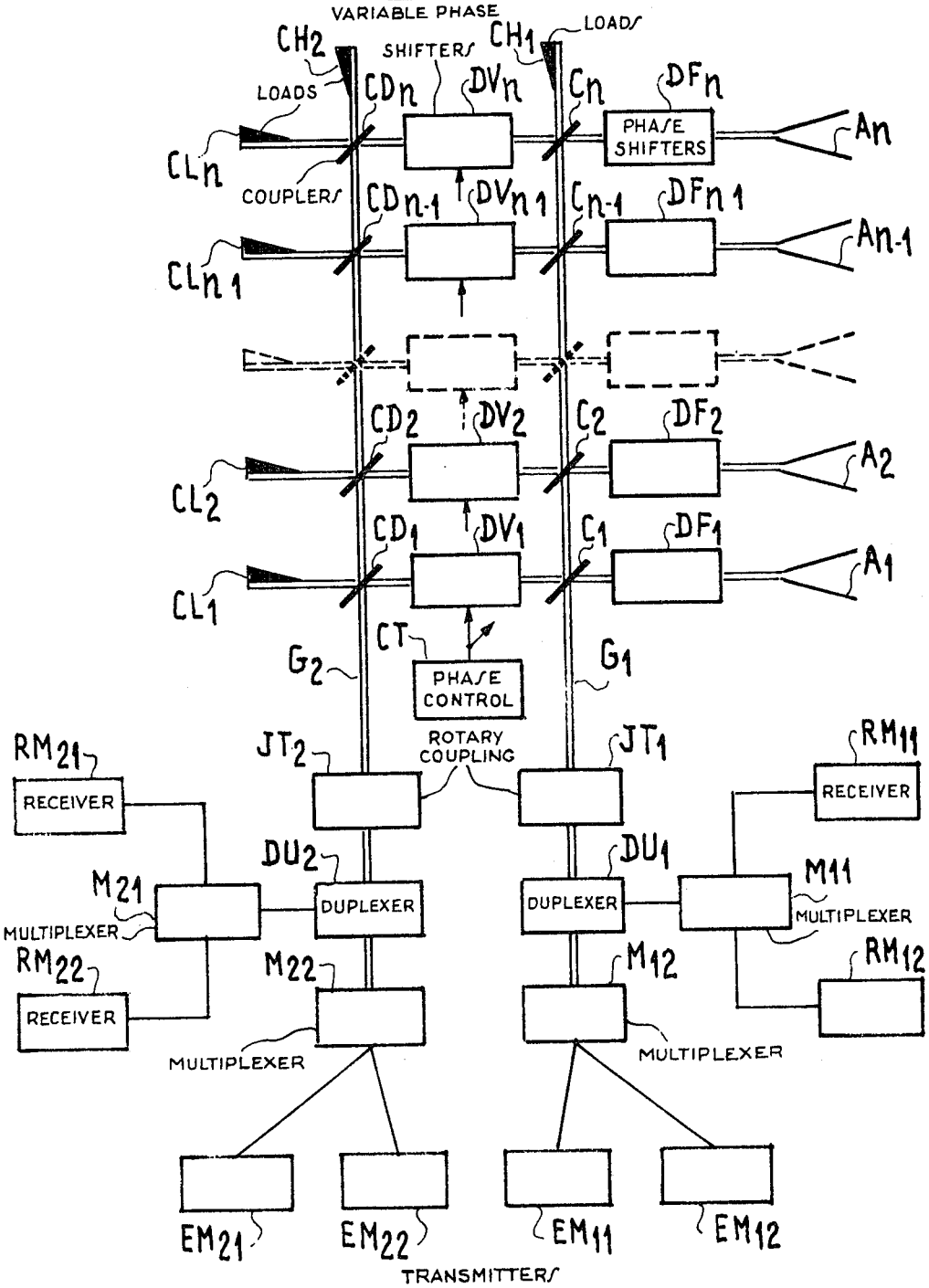
FIG. 10 is a block diagram of an embodiment of my invention comprising an antenna with a plurality of transmitters and receivers.

FIG. 10 shows an antenna employing electronic scanning according to the invention in which it is desired to have two fixed-elevation beams and two variable-elevation beams.

This Figure repeats, with the same reference characters, a large part of FIG. 2. There has merely been added to the lower end of the waveguide $G_1$, beyond the rotary joint $JT_1$, connection from a low-level multiplexer M11 working into two receivers $RM_{11}$, $RM_{12}$ and another such connection to a high-level multiplexer M12 supplied by two transmitters $EM_{11}$ and $EM_{12}$ operating at two different frequencies.

Similarly, the duplexer $DU_2$ disposed at the lower end of the waveguide $G_2$, beyond the rotary joint $JT_2$, is connected to a low-level multiplexer $M_{21}$ and to a high-level multiplexer $M_{22}$. The multiplexer $M_{21}$ works into two receivers $RM_{21}$ and $RM_{22}$ whereas multiplexer $M_{22}$ is supplied by two transmitters $EM_{21}$ and $EM_{22}$ operating at two different frequencies which also differ from those of the transmitters $EM_{11}$ and $EM_{12}$ associated with the waveguide $G_1$.

The operation of a system such as that diagrammatically represented in FIG. 10 is not basically different from that of the system of FIG. 2 or that of FIG. 5 including a third feed waveguide G3. The energy respectively delivered by the transmitters $EM_{11}$ and $EM_{12}$ at different frequencies preferably close to each other, with suitable selection of the values of the fixed phase shifters $DF_1$ to $DF_n$, contributes to the production of two search beams which are adjacent of each other at slightly different angles of elevation.

Likewise, the energy respectively delivered by the transmitters $EM_{21}$ and $EM_{22}$ at two different frequencies which differ from those of the transmitters $EM_{11}$ and $EM_{12}$, with an appropriate setting of the variable phase shifters $DV_1$ to $DV_n$, contributes to the production of two beams adjacent tracking beams having jointly variable angles of elevation.

As concerns the reception, the same consideration as those discussed in conjunction with FIGS. 2 and 5 apply.

Moreover, it is evident that the number of transmitters and receivers may be different from that shown in FIG. 10, depending on the use to which the antenna according to the invention is to be put.

What is claimed is:

1. An electronically scanned antenna comprising:

a linear array of vertically stacked radiators capable of emitting and intercepting microwave energy;

a first and a second waveguide paralleling said array;

a set of first couplers communicating with said first waveguide at a number of spaced-apart locations corresponding to the number of said radiators;

a set of second couplers communicating with said second waveguide at a number of spaced-apart locations corresponding to the number of said radiators;

first transmitter means with at least one first operating frequency connected to said first waveguide;

a set of fixed phase shifters respectively inserted between said first couplers and said radiators for energizing same to emit at least one first beam of microwave energy at said first operating frequency, said first beam having a constant angle of elevation;

second transmitter means with at least one second operating frequency connected to said second waveguide;

a set of variable phase shifters respectively inserted between said first and second couplers in cascade with said fixed phase shifters for energizing said radiators to emit at least one second beam of microwave energy at said second operating frequency, said second beam having an angle of elevation depending on the setting of said variable phase shifters;

first receiver means connected to said first waveguide for detecting intercepted echoes at said first operating frequency; and second receiver means connected to said second waveguide for detecting intercepted echoes at said second operating frequency.

2. An antenna as defined in claim 1 wherein each of said waveguides has one end connected to the associated transmitter means and receiver means through a duplexer, the other end of each waveguide being terminated by a dissipative load.

3. An antenna as defined in claim 2 wherein said waveguides, couplers, phase shifters and radiators form an assembly rotatable in azimuth, further comprising rotary coupling means inserted between each of said waveguides and the respective duplexer.

4. An antenna as defined in claim 2 wherein each of said transmitter means comprises a plurality of transmitters connected via a multiplexer to an input of the respective duplexer, each of said receiver means comprising a plurality of receivers connected via another multiplexer to an output of the respective duplexer, the operating frequencies of all transmitters being different from one another, whereby a plurality of first and second beams are generated.

5. An antenna as defined in claim 1, further comprising a third waveguide paralleling said array, a set of third couplers communicating with said third waveguide at a number of spaced-apart locations corresponding to the number of said radiators, a set of invariable phase shifters respectively inserted between said second and third couplers in cascade with said variable phase shifters, and third receiver means connected to said third waveguide for detecting intercepted echoes at said second operating frequency in a mode different from that of said second receiver means.

6. An antenna as defined in claim 5 wherein each of said transmitter means comprises a plurality of transmitters and each of said receiver means comprises a plurality of receivers, the operating frequencies of all transmitters being different from one another.

* * * * *